US006418712B2

(12) United States Patent
Darley

(10) Patent No.: US 6,418,712 B2
(45) Date of Patent: Jul. 16, 2002

(54) ENGINE BREATHER APPARATUS

(75) Inventor: Andrew Darley, Bourne (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 09/737,000

(22) Filed: Dec. 14, 2000

(30) Foreign Application Priority Data

Jan. 20, 2000 (GB) ..... 0001314

(51) Int. Cl.[7] ..... F01N 3/00
(52) U.S. Cl. ..... 60/283; 285/354
(58) Field of Search ..... 60/283; 123/568.11, 123/568.17, 568.18; 285/354, 133.11, 133.3, 133.4, 252, 253, 368

(56) References Cited

U.S. PATENT DOCUMENTS

| | | | | | |
|---|---|---|---|---|---|
| 1,992,265 | A | * | 2/1935 | Weeks | 60/283 |
| 2,488,563 | A | * | 11/1949 | Sills | 60/283 |
| 2,543,194 | A | * | 2/1951 | Paris, Jr. | 60/283 |
| 2,969,940 | A | * | 1/1961 | Gengler | 60/283 |
| 3,050,376 | A | * | 8/1962 | Bishop et al. | 60/283 |
| 3,224,188 | A | * | 12/1965 | Barlow | 60/283 |
| 3,232,373 | A | * | 2/1966 | Bjork | 60/283 |
| 3,263,412 | A | * | 8/1966 | Thompson | 60/283 |
| 3,846,980 | A | * | 11/1974 | DePalma | 60/283 |
| 4,827,715 | A | * | 5/1989 | Grant et al. | 60/283 |

FOREIGN PATENT DOCUMENTS

| | | |
|---|---|---|
| GB | 132071 | 9/1919 |
| GB | 1531080 | 11/1978 |

* cited by examiner

*Primary Examiner*—Thomas Denion
*Assistant Examiner*—Diem Tran
(74) *Attorney, Agent, or Firm*—John J. Cheek; Alan J. Hickman

(57) ABSTRACT

A breather gas outlet has an adaptor having a hollow member with a first end engaged at an aperture in a wall of an exhaust system of an engine to allow breather gas flow thereinto. A nozzle has a second hollow member serves as a breather gas conduit and is positioned inside the adaptor. The nozzle has a mounting portion sealingly engaged with an inside surface of the adaptor towards a second end thereof. And, a nozzle portion extends laterally towards but ends short of the first end thereof. The nozzle portion has an outer dimension less than the inner dimension of the adaptor so as to form a space therebetween.

16 Claims, 5 Drawing Sheets

ENGINE BREATHER APPARATUS

TECHNICAL FIELD

The present invention relates to an internal combustion engine breather apparatus and in particular an improved apparatus for introducing internal combustion engine breather gases into the exhaust gas stream of an internal combustion engine.

BACKGROUND ART

In an internal combustion engine such as a diesel engine, the pressure differential above and below the piston causes a small amount of gas leakage from the combustion chamber past the piston and into the crankcase. The pressure rise thus brought about in the crankcase can lead to oil being forced past the crankcase oil seals and causing other similarly undesirable effects.

It is known to maintain a relatively constant and low level of crankcase pressure by connecting the crankcase to the environment via an open breather through which gas may pass. However, there are disadvantages to open breathers in that oil droplets may coalesce and drip form the breather, thus contravening environmental regulations or expectations in respect of fluid leakage from machines. Further, gas pressure pulsation may cause dust from the local environment to be drawn into the engine.

To overcome the above-mentioned problems, it is known to provide closed circuit breather systems in which the breather gas is fed into the intake air of the engine for subsequent combustion. However, some of the oil carried with the breather gas will carbonise upon contact with hot engine components such as turbocharger compressors and intake air intercoolers and thus impede air flow. To reduce this problem, gas/oil separators are often employed but these add cost to the engine and do not totally remove the oil content of the breather gas, particularly where this is in the form of a fine aerosol rather than sizeable droplets.

A further problem with closed circuit breathers connected to the engine air intake system concerns the risk of oil carryover into the air intake system in such quantity that the engine may become fueled by the oil and engine run-away (uncontrolled engine acceleration) may hence occur.

In an effort to overcome one or more of the above-mentioned problems, it has been proposed in the prior art (for example, patents GB 1531080 and DE 3312818) to feed the breather gas into the exhaust system of the engine. A disadvantage of feeding the breather gas into the exhaust before the muffler, or silencer, is that a device such as a venturi will be needed to reduce the pressure in the exhaust pipe at the point of entry of the breather gas, such that the resultant pressure in the crankcase remains at a relatively constant and low level. The prior art generally either discloses passing the breather gas into the exhaust at a point relatively close to the engine or is silent regarding the point in the exhaust at which the breather gas enters. An exception is Japanese unexamined patent application 8-61037 which proposes that the breather gas be introduced into the exhaust system at a point downstream of the muffler. However, the apparatus disclosed within JP 8-61037 has severe disadvantages as are described forthwith.

In JP 8-61037, the breather pipe outlet passes through the wall of the muffler tailpipe and is contained largely within the tailpipe in the flow of the exhaust gas stream. The mass flow of exhaust gas will be far higher than the mass flow of breather gas, hence the breather pipe outlet will be at, or very close to, the exhaust gas temperature which can range up to 560° C. in the tailpipe of a turbocharged diesel engine exhaust system. Lubricating oil carbonizes at around 180–200° C., therefore a significant proportion of the oil carried within the breather gas during its passage through the breather pipe outlet will carbonize and this will very quickly block the outlet and cause an unacceptably high crankcase pressure. Frequent and possibly difficult decarbonization will thus be needed.

Further, an apparatus constructed in accordance with JP 8-61037, with the breather pipe outlet normal to the wall of the tailpipe but formed with a bend, will not only severely exacerbate the carbonization and subsequent decarbonizing problems but will prove relatively expensive to manufacture and install.

The present invention is directed to overcoming one or more of the problems set forth above.

DISCLOSURE OF THE INVENTION

In one aspect of the present invention, a breather gas outlet for an internal combustion engine having an exhaust system is provided. The exhaust system has a wall and an aperture disposed in the wall. The breather breather gas outlet has an adaptor with a hollow member. The hollow member has a first end adapted to engage in the aperture of the wall of the exhaust system and provide a breather gas communication into the exhaust system. A nozzle having a second hollow member to serve as a breather gas passage is positioned inside the adaptor. The nozzle has a mounting portion sealingly engaging with an inside surface of the adaptor towards a second end of the adaptor. A nozzle portion extends laterally towards and ending short of the first end of the adaptor. The nozzle portion has an outer dimension less than an inner dimension of the adaptor and defining a space therebetween.

In another aspect of the present invention, an exhaust system is provided with a wall and an aperture disposed in the wall. A breather gas outlet is engaged with the wall of the exhaust system and delivers breather gas communication into the exhaust system. The breather gas outlet has an adaptor and a nozzle. The adaptor has a hollow member with a first end adapted to engage in the aperture of the wall of the exhaust system and deliver the breather gas communication into the exhaust system. The nozzle has a second hollow member serving as a breather gas passage and is positioned inside the adaptor. The nozzle has a mounting portion sealingly engaging with an inside surface of the adaptor towards a second end of the adaptor and a nozzle portion extending laterally towards but ending short of the first end of the adaptor. The nozzle portion has an outer dimension less than an inner dimension of the adaptor and defining a space therebetween.

In yet another aspect of the present invention, a breather system has a breather gas outlet and a breather gas conduit adapted to be connected to a crankcase of and internal combustion engine. An exhaust system is adapted to being connected to the internal combustion engine. The exhaust system has a wall and an aperture disposed in the wall. The breather gas outlet is engaged with the wall of the exhaust system and delivers breather gas flow into the exhaust system. The breather gas outlet has an adaptor and a nozzle. The adaptor has a hollow member with a first a first end adapted to engage in the aperture of the wall of the exhaust system and deliver the breather gas into said exhaust system. The nozzle has a second hollow member serving as a breather gas passage which is positioned inside the adaptor.

The nozzle has a mounting portion sealingly engaging with an inside surface of the adaptor towards a second end of the adaptor and a nozzle portion extending laterally towards but ending short of the first end of the adaptor. The nozzle portion has an outer dimension less than an inner dimension of the adaptor and defining a space therebetween.

In yet another aspect of the present invention, there is provided a method of fitting a breather gas outlet to an engine exhaust. The method includes the steps of: providing a hollow nozzle member at a downstream end of a breather gas conduit; mounting the nozzle inside a hollow adaptor member, by sealingly engaging a mounting portion of the nozzle with an inside surface of the adaptor, such that a nozzle portion of the nozzle extends laterally towards but ends short of a downstream end of the adaptor, the nozzle portion having an outer dimension less than the inner dimension of the adaptor so as to form a space therebetween; and engaging the downstream end of the adaptor at an aperture in a wall of an exhaust system of an engine to provide a breather gas communication thereinto.

BEST MODE FOR CARRYING OUT THE INVENTION

Figure 1:
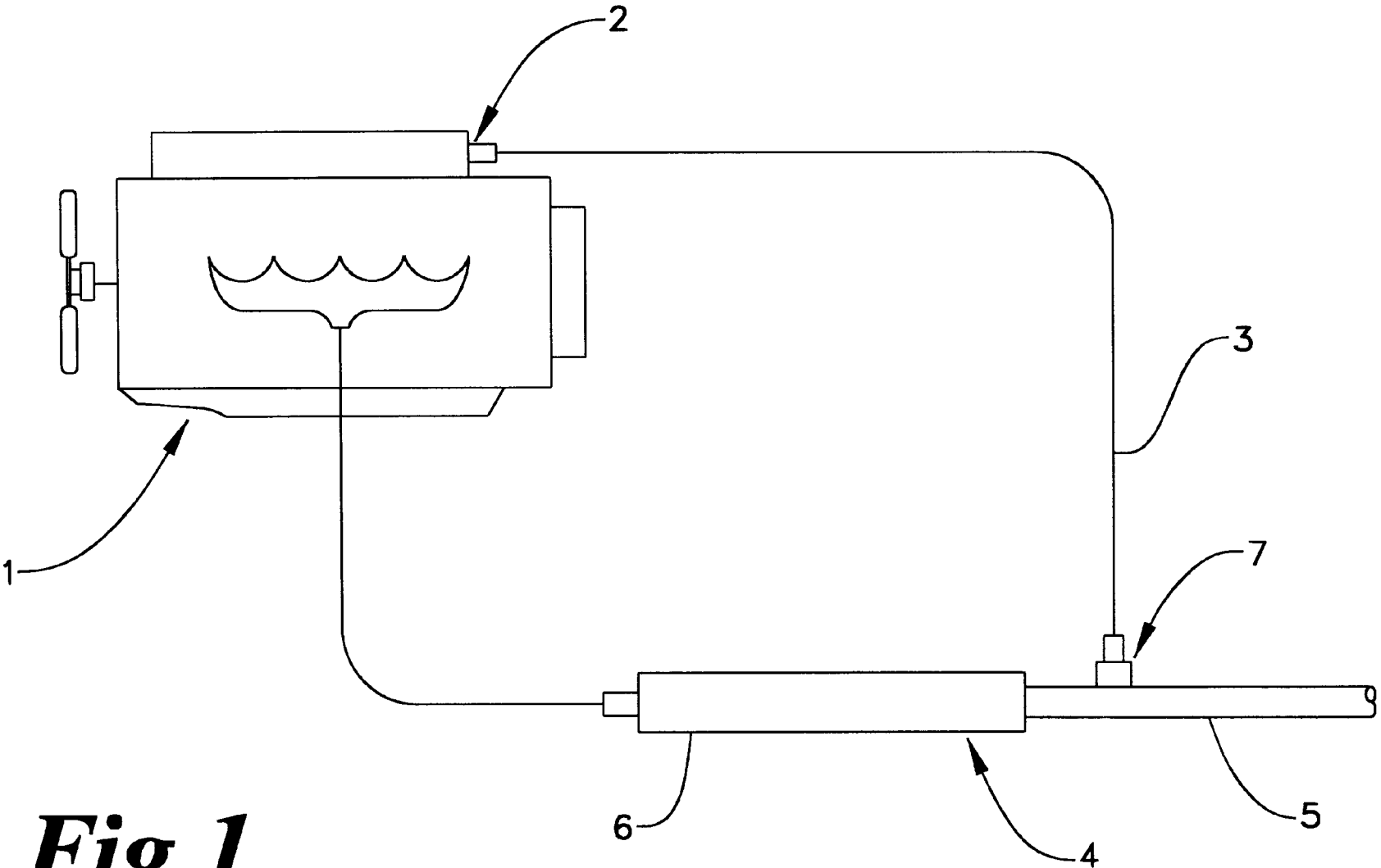
FIG. 1 is a schematic drawing of an embodiment of the present invention showing the breather gas system of the present invention fluidly connecting the exhaust and crankcase of an internal combustion engine.

Referring to the drawings, FIG. 1 shows an internal combustion engine 1 having a breather gas outlet 2 to which is connected a flexible breather pipe 3 having, in this example, and inside diameter of 20 mm. The pipe is terminated by a breather gas outlet 7 in accordance with a aspect of the invention, providing fluid communication with an exhaust system 4 which terminates in a tailpipe 5 connected to a muffler 6. The tailpipe 5, in this example, has a bore of about 60 mm.

Figure 2:
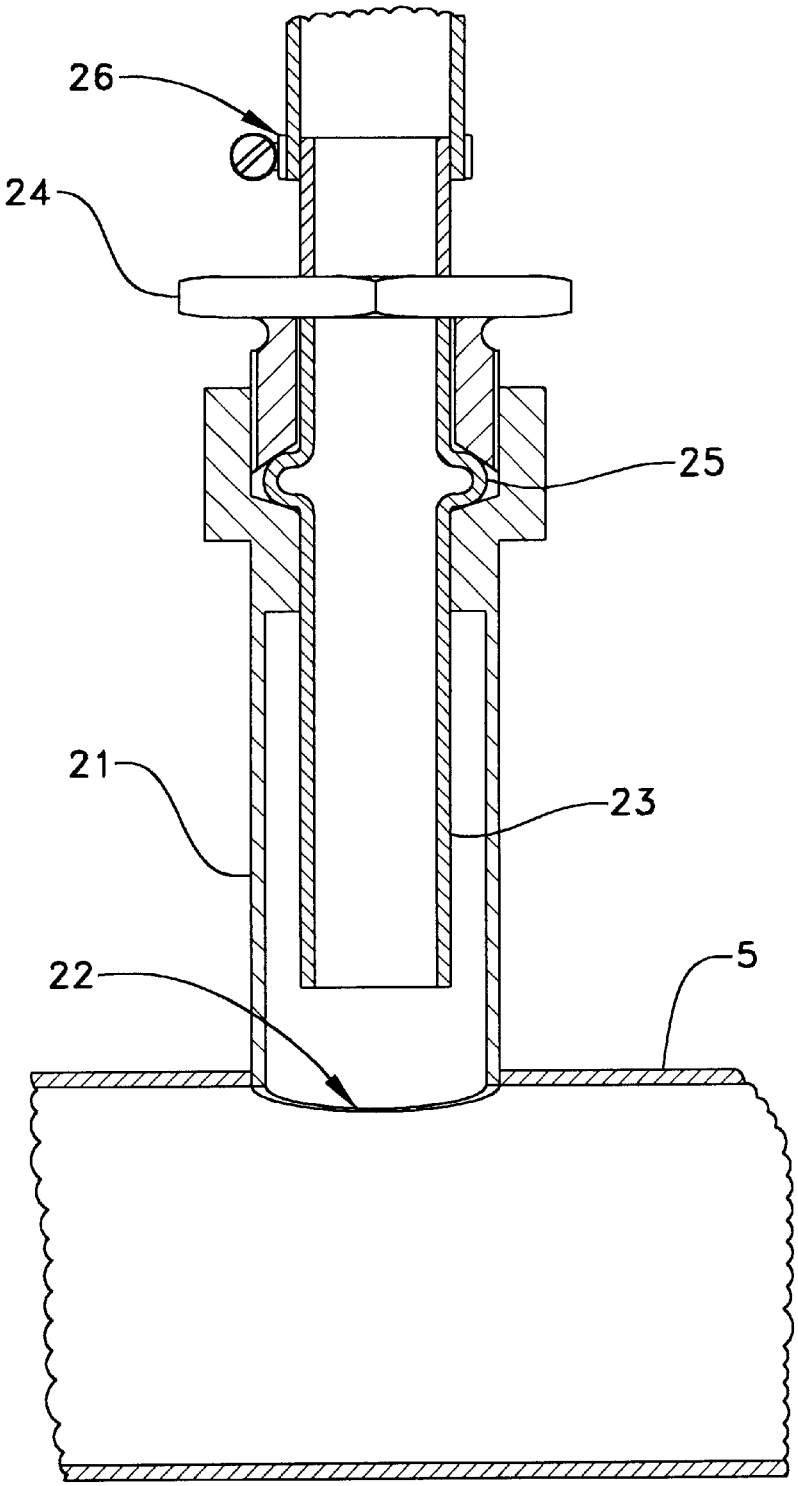
FIG. 2 is a diagrammatic cross-sectional drawing of an embodiment of the breather gas outlet of the breather gas system of FIG. 1.

FIG. 2 shows a ferrous adaptor 21 of about 80 mm in length with a through bore of about 21.3 mm diameter and about 60 mm length. The adaptor 21 is welded to a wall of the tailpipe 5 with the counterbore in fluid communication with a port 22 through the wall of the tail pipe 5. The adaptor 31 may be positioned at any location along the tailpipe 5 but is preferably positioned relatively close to the muffler end. The adaptor 21 can be attached to the tailpipe 5 by alternative methods such as bolt, rivits or threadedly engaged.

A breather nozzle 23 in length of about 148 mm, outside diameter at about 21.3 mm and inside diameter of about 16 mm is introduced into the bore and counterbore of the adaptor 21 until a first end is spaced about 12 mm inwardly from the first end of the adaptor 21 and is connected to the adaptor 21 in this position by a force applying member, such as, a pipe-nut 24 acting on a swage 25. The breather pipe 3 is connected to a second end of the nozzle 23 by a hose clamp 26. The breather nozzle 23 can be attached to the adaptor 21 by alternative methods such as welding, bolting, riviting or threading.

Figure 3:
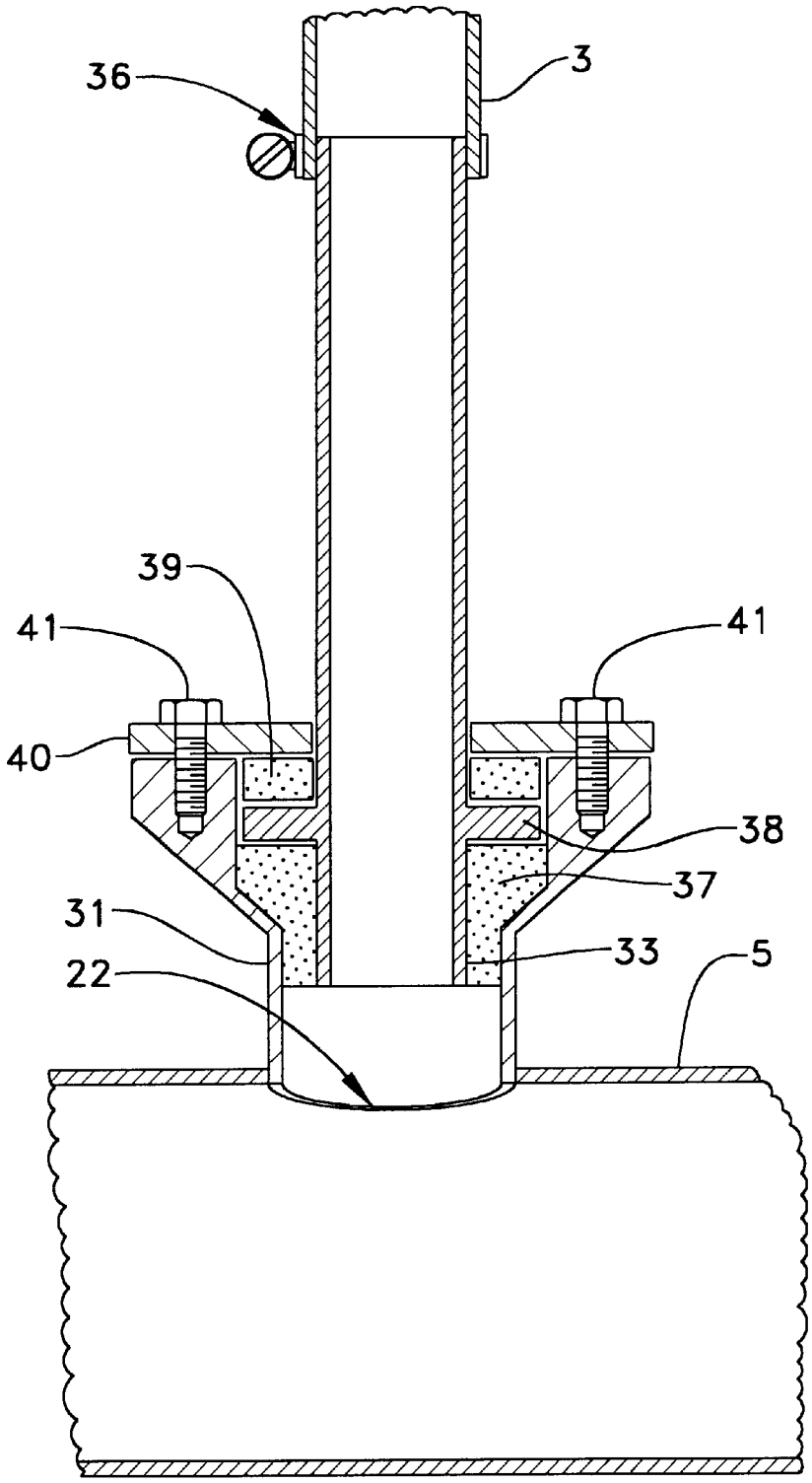
FIG. 3 is a diagrammatic cross-sectional drawing of another embodiment of the breather gas outlet of the breather gas system of FIG. 1.

Referring to FIG. 3, another embodiment of the present invention, an adaptor 31 terminates at the second end in a drilled and tapped face and includes a recess into which is placed an insert 37 manufactured from a thermally insulating material, for example a ceramic material.

A nozzle 33 having a flange 38 is spaced apart from the first end by an amount equal to the length of the insert 37 and of slightly smaller diameter then the maximum diameter of the insert 37. The first end of the nozzle 33 is introduced into the insert 37 until the flange 38 engages with the insert 37 and hence the first end of the nozzle 33 is approximately level with a first end of the insert 37.

A thermally insulating washer 39 and a clamping plate 40 are placed over the second end of the nozzle 33 and the clamping place 40 is held to the tapped face of the adaptor 31 by threaded fasteners 41, thus clamping the washer 39, nozzle flange 38 and insert 37 to the adaptor 31. The flexible breather pipe 3 is then retained to the second end of the nozzle 33 with the hose clamp 36. Thus the breather pipe 3 and nozzle 33 are thermally insulated from the exhaust system.

INDUSTRIAL APPLICABILITY

During engine operation, breather gases generated within the internal combustion engine 1 are conveyed via the breather pipe 3 to the nozzle 23 and exit from the first end of the nozzle 23 into an exhaust gas stream passing through the exhaust tailpipe 5. The reduced internal diameter of the nozzle 23 in relation to the breather pipe 3 will cause the breather gas to increase in velocity before exiting the nozzle 23 to the extent that a substantial proportion of oil mist or droplets contained within the breather gas will be swept into the exhaust gas stream passing through the tailpipe 5 rather than coalescing within or around the nozzle 23 or dripping from it to foul the vicinity.

A benefit identified in tests with an apparatus constructed as described above, with a radial clearance between the nozzle 23 and the adaptor 21 of 3.5 mm in combination with the first end of the nozzle 23 being set back from the first end of the adaptor 21 by 12 mm, was a surprisingly substantial difference in temperature between the exhaust gas stream and the nozzle 23.

In the example apparatus, as adapted to a turbocharged diesel engine, the temperature differences between the exhaust gas in the tailpipe 5 and the breather nozzle 23 ranged to over 400° C. under high speed, full load, conditions. Thus, with a typically maximum exhaust tailpipe gas temperature of 560° C. under these conditions, the breather nozzle 23 had a temperature in the region of 160° C., comfortably below the oil carbonization temperature of 180–200° C. the result of this is that any oil mist or droplets collecting in or around the nozzle 23 will not carbonize and the apparatus will therefore not require frequent decarbonizing maintenance.

It should be noted that the dimensions given for the example apparatus were those found to provide the best mode for this particular example only and will vary from apparatus to apparatus depending upon at least the exhaust and breather gas flow rates, the exhaust gas temperature and the exhaust tailpipe diameter. The given dimensions may be used as a starting point for other installations of the apparatus but the optimum dimensions will need to be found by experimentation.

In tests on the apparatus of FIG. 3, in comparison with tests on the apparatus of FIG. 2, small improvements were found in the temperature difference between the exhaust gas and the breather nozzle, probably a result of the inability for exhaust gas to gain entry between the adaptor and the nozzle.

The improvements in temperature differentials that will be brought about with the apparatus of the first embodiment of the present invention compared with the apparatus disclosed in the prior art are considerable. However, there may be instances where the further small improvements brought about the apparatus of the second embodiment can be usefully employed. The test performance of the example apparatus of each embodiment of the present invention will be apparent with reference to FIGS. 4 and 5.

Figure 4:
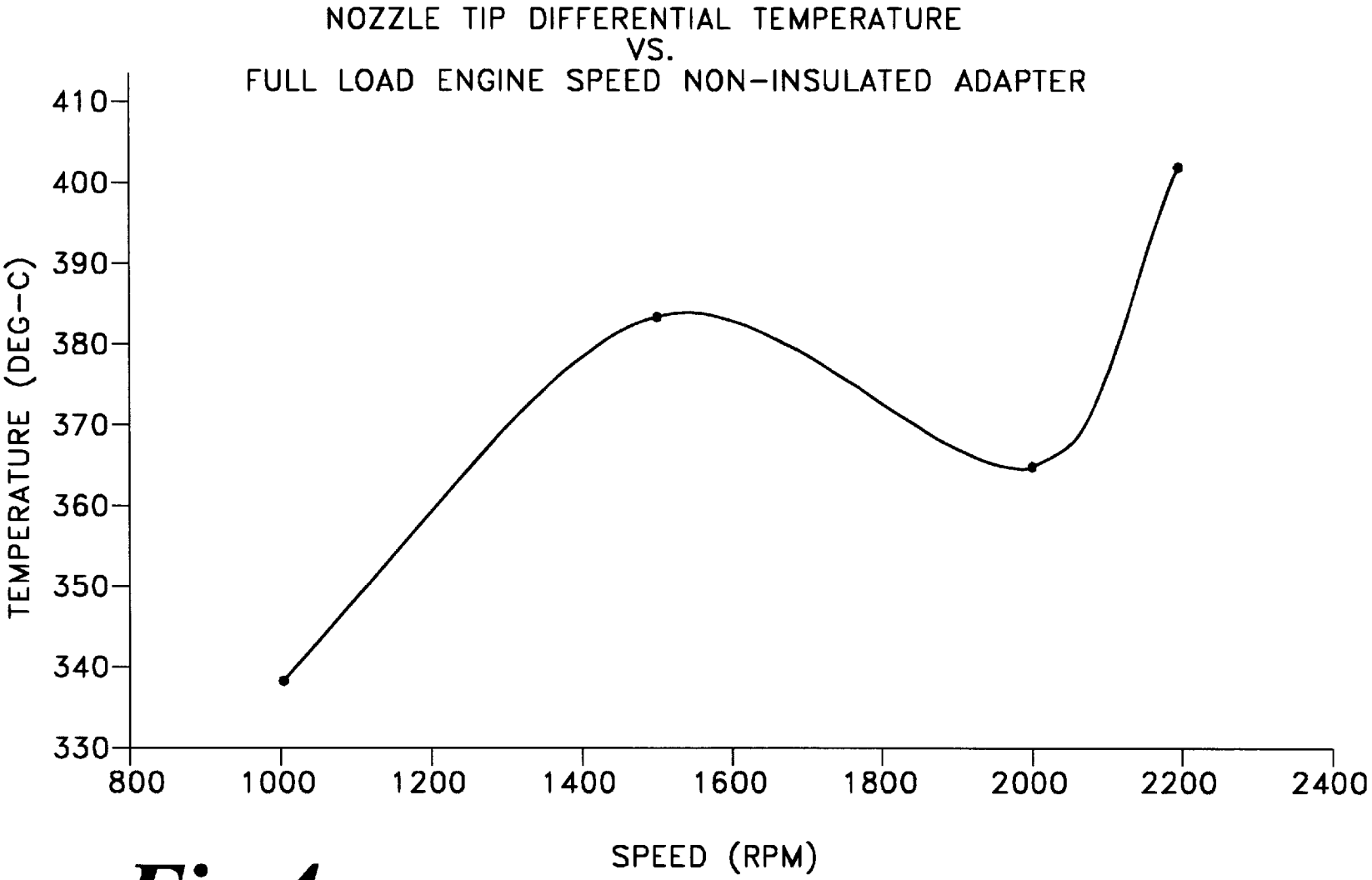
FIG. 4 shows a graph depicting the variation of temperature differential verses engine speed brought about by the embodiment of FIG. 2.

FIG. 4 represents the test results for an engine and exhaust system fitted with an apparatus in accordance with the first embodiment (FIG. 2) of the present invention. The temperature differential readings were taken over a range of engine speeds with the engine running at full load.

Note that the dip in the temperature differential at an engine speed of 2000 rpm may be due to turbulent instability in the exhaust/breather gas flows at that speed.

Figure 5:
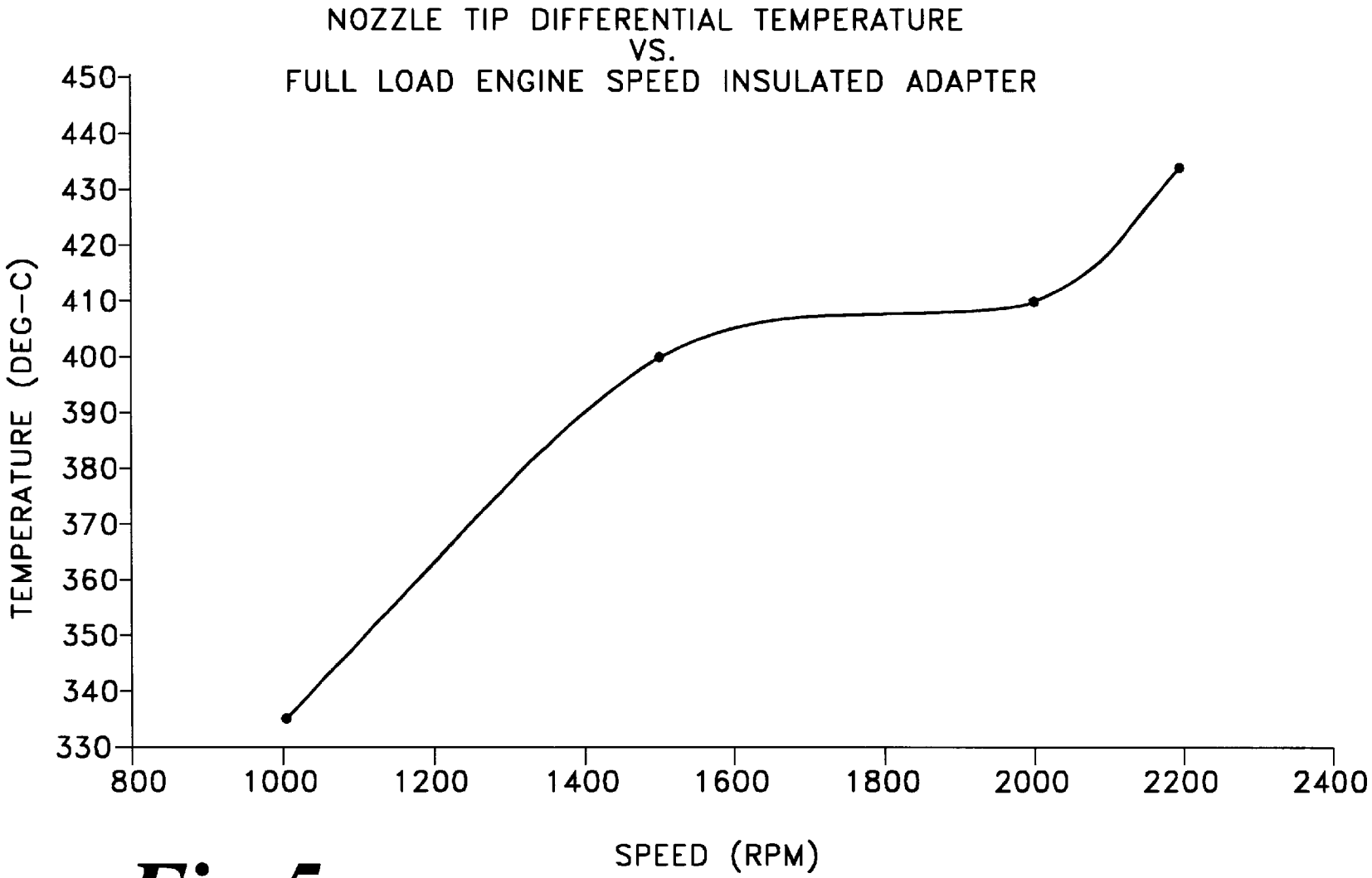
FIG. 5 shows a graph depicting the variation of temperature differential verses engine speed brought about by the apparatus of FIG. 3.

FIG. 5 discloses the test results for an engine and exhaust system fitted with an apparatus including a ceramic or similar nozzle insulating means in accordance with the second embodiment. As with FIG. 4, the temperature differential readings were taken over a range of engine speeds with the engine running at full load.

Each embodiment of the apparatus was found to provide a crankcase pressure well within the range acceptable for an engine fitted with a closed circuit breather, specifically +20 /−50 mm $H_2O$. This was facilitated by the approximately proportional relationship between mass exhaust gas and mass breather gas flow levels over the majority of the engine speed and load range. Hence no additional apparatus was required to dampen pressure pulses or control crankcase pressure levels within the engine.

Setting back the nozzle away from the aperture in the wall of the exhaust reduces the flow of exhaust gases around the nozzle, thus reducing heating of the nozzle by the exhaust gases. Carbonizing of the oil content of the breather gases is thereby significantly reduced, reducing maintenance/cleaning/service requirements.

Preferably, the end of the nozzle is set back a distance between 40% and 150% of the bore diameter, and more preferably between 60% and 100% of the bore diameter.

The effect is enhanced by ensuring that, towards the downstream end of the outlet means where the adaptor engages over an aperture in the exhaust, the nozzle is dimensioned such that the nozzle wall is spaced apart from the adapter wall.

Even where this is merely an air gap, the feature has some insulating effect. This is enhanced in an alternative embodiment of the invention, wherein heat insulating material, such as a ceramic, is provided in the space between the inner surface of the adaptor and the outer surface of the nozzle.

The inclusion of a heat insulator between the adaptor and the nozzle further increases the temperature differential between the exhaust gas/wall and the breather gas/nozzle both by limiting the low of any exhaust gas around the outer wall of the nozzle and by limiting transfer of heat from the adaptor to the nozzle. The carbonization of any oil present in the breather gas is thus further reduced.

Preferably, one or both of the adaptor and nozzle is a body of rotation. The nozzle portion of the nozzle and the corresponding surrounding forward portion of the adaptor may be substantially cylindrical and may be concentric. Alternatively, other profiles may be preferred. For example, the nozzle portion may be tapered.

It will be appreciated by the man skilled in the art that it will frequently be convenient for the breather gas outlet means to be positioned to engage the exhaust downstream of its muffler, for example at a sidewall of a tailpipe of the exhaust, given the pressure differential considerations discussed above. However, it will be understood that the invention is not restricted to such a position and that standard modifications known to the skilled many could be made to the apparatus of the invention to enable it to be positioned upstream of the muffler. For example, means, such as a venturi, may be provided.

The apparatus of the present invention will normally preclude the need for a breather gas/oil separator. However, if the particular characteristics of the engine require a separator, this can be included in a conventional manner.

Other aspects, objects and advantage of this invention can be obtained form a study of the drawings, the disclosure and the appended claims.

What is claimed is:

1. A breather gas outlet for an internal combustion engine having an exhaust system, said exhaust system having a wall, and an aperture disposed in the wall of the exhaust system, said breather gas outlet comprising;

an adaptor having a hollow member, said hollow member having a first end adapted to engage in the aperture of the wall of the exhaust system and provide a breather gas communication thereinto;

a nozzle having a second hollow member to serve as a breather gas passage and being positioned inside the adaptor, said nozzle having a mounting portion sealingly engaging with an inside surface of the adaptor towards a second end of the adaptor; and a nozzle portion extending laterally towards but ending short of the first end of the adaptor, said nozzle portion having an outer dimension less than an inner dimension of the adaptor and defining a space therebetween.

2. A breather gas outlet as claimed in claim 1, wherein heat insulating material is provided in the space between the inner surface of the adaptor and the outer surface of the nozzle.

3. A breather gas outlet as claimed in claim 1, wherein at least one of the adaptor and nozzle is substantially a body of rotation.

4. A breather gas outlet as claimed in claim 1, wherein the adaptor is adapted to engage the wall of the exhaust system such as to extend substantially perpendicular to the wall of the exhaust system when so engaged.

5. A breather gas outlet for an internal combustion engine having an exhaust system, said exhaust system having a wall, and an aperture disposed in the wall of the exhaust system, said breather gas outlet comprising:

an adaptor having a hollow member, said hollow member having a first end adapted to engage in the aperture of the wall of the exhaust system and provide breather gas communication thereinto;

a nozzle having a second hollow member to serve as a breather gas passage and being positioned inside the adaptor, said nozzle having a mounting portion sealingly engaging with an inner surface of the adaptor towards a second end of the adaptor;

a nozzle portion extending laterally towards but ending short of the first end of the adaptor, said nozzle portion having an outer dimension less than an inner dimension of the adaptor and defining a space therebetween;

a circumferential projection on the inner surface of the adaptor;

a swage on the mounting portion of the nozzle; and a force applying member urging the projection on the adaptor and the swage together and sealingly engaging the adaptor with the nozzle.

6. A breather gas outlet as claimed in claim 5, wherein the force applying member comprises a nut.

7. A breather gas outlet as claimed in claim 1 wherein the nozzle is provided with a flange, a first side of the flange limiting the extent to which the nozzle is inserted into the adaptor, the other side thereof being in contact with an insulating washer, held in position by a cover plate releasably secured to the adaptor so as to sealingly engage the adaptor and nozzle.

8. An exhaust system, comprising:

an exhaust having a wall and an aperture disposed in the wall;

a breather gas outlet being engaged with the wall of the exhaust and delivering breather gas into the exhaust;

said breather gas outlet having an adaptor and a nozzle, said adaptor having a hollow member, said hollow member having a first end adapted to engage in the aperture of the wall of the exhaust and deliver breather gas into said exhaust;

said nozzle having a second hollow member serving as a breather gas passage and being positioned inside the adaptor, said nozzle having a mounting portion sealingly engaging with an inside surface of the adaptor towards a second end of the adaptor and a nozzle portion extending laterally towards but ending short of the first end of the adaptor, said nozzle portion having an outer dimension less than an inner dimension of the adaptor and defining a space therebetween.

9. An exhaust system as claimed in claim 8, wherein the breather gas outlet is engaged to the exhaust downstream of its muffler.

10. An exhaust system as claimed in claim 9, wherein the breather gas outlet is engaged to a side wall of a tailpipe of the exhaust.

11. An exhaust system as claimed in claim 8, wherein part of the breather gas outlet is formed integrally with the exhaust.

12. A breather system, comprising:

a breather gas outlet;

a breather gas conduit adapted to be connected to a crankcase of and internal combustion engine;

an exhaust system adapted to being connected to said internal combustion engine, said exhaust system having a wall and an aperture in said wall, said breather gas outlet being engaged with a wall of the exhaust system and delivering breather gas into the exhaust system;

said breather gas outlet having an adaptor and a nozzle, said adaptor having a hollow member, said hollow member having a first end adapted to engage in the aperture of the wall of the exhaust system and deliver the breather gas into said exhaust system;

said nozzle having a second hollow member serving as a breather gas passage and being positioned inside the adaptor, said nozzle having a mounting portion sealingly engaging with an inside surface of the adaptor towards a second end of the adaptor and a nozzle portion extending laterally towards but ending short of the first end of the adaptor, said nozzle portion having an outer dimension less than an inner dimension of the adaptor and defining a space therebetween.

13. A breather system as claimed in claim 12, wherein the breather gas conduit includes a flexible pipe.

14. A breather system as claimed in claim 12, wherein a gas/oil separator is provided in the breather gas stream.

15. A method of fitting a breather gas outlet to an engine exhaust, comprising the steps of:

(a) providing a hollow nozzle member at a downstream end of a breather gas conduit;

(b) mounting the nozzle inside a hollow adaptor member, by sealingly engaging a mounting portion of the nozzle with an inside surface of the adaptor, such that a nozzle portion of the nozzle extends laterally towards but ends short of a downstream end of the adaptor, the nozzle portion having an outer dimension less than the inner dimension of the adaptor so as to form a space therebetween; and (c) engaging the downstream end of the adaptor at an aperture in a wall of an exhaust system of an engine to provide a breather gas communication thereinto.

16. A breather gas outlet for an internal combustion engine having an exhaust conduit, said breather gas outlet comprising:

a first hollow member having a first end opening into said exhaust conduit;

a second hollow member forming a breather gas passage, a portion of said second hollow member being positioned inside the first hollow member, said second hollow member having a mounting portion engaging with an inner surface of the first hollow member and a nozzle portion extending laterally towards but ending short of the first end of the first hollow member, said nozzle portion having an outer dimension less than an inner dimension of the first hollow portion and defining a space therebetween.

* * * * *